US005358435A

United States Patent [19]

Rodskier

[11] Patent Number: 5,358,435

[45] Date of Patent: Oct. 25, 1994

[54] BOAT PROPULSION UNIT

[75] Inventor: Christian Rodskier, Torslanda, Sweden

[73] Assignee: AB Volvo Penta, Gothenburg, Sweden

[21] Appl. No.: 79,804

[22] Filed: Jun. 22, 1993

[30] Foreign Application Priority Data

Jun. 22, 1992 [SE] Sweden ..... 9201909

[51] Int. Cl.[5] ..... B63H 5/12

[52] U.S. Cl. ..... 440/61

[58] Field of Search ..... 440/61, 63

[56] References Cited

U.S. PATENT DOCUMENTS 3,006,311 10/1961 Hansson et al. ..... 440/63
3,175,529 3/1965 Bergstedt ..... 440/61
3,626,467 9/1969 Mazziotti ..... 440/61
4,544,362 10/1965 Arneson ..... 440/61

*Primary Examiner*—Jesus D. Sotelo
*Attorney, Agent, or Firm*—Young & Thompson

[57] ABSTRACT

Boat propulsion unit comprising a suspension arrangement (2) and a propeller drive shaft housing (3) which, via a lower and an upper universal joint (22, 24 resp.), are pivotally connected to each other. A hydraulic piston-cylinder arrangement (35) has its cylinder connected to the upper joint and, at the lower end of its piston rod, presents a forked bracket (39) which is pivotally connected to an upper region of the drive shaft housing. At a distance from the upper joint (24), the cylinder (34) of the arrangement presents attachments for a steering mechanism, by means of which the arrangement is displaceable about a vertical axis (a). The embodiment implies that the piston-cylinder arrangement serves both as a trim and tilt cylinder as well as a rudder.

5 Claims, 2 Drawing Sheets

BOAT PROPULSION UNIT

TECHNICAL FIELD

The present invention relates to a boat propulsion unit intended to be suspended on the outside of a boat transom and driveably connected to an engine on the inside of the transom, said unit comprising a propeller drive shaft housing, a suspension arrangement intended to be fixedly secured to the transom, pivot means which pivotally connect the drive shaft housing to the suspension arrangement to allow pivotal displacement of the drive shaft housing relative to the suspension arrangement about a pivot axis in a vertical plane and a pivot axis in horizontal plane, steering means which are arranged to effect pivotal displacement of the drive shaft housing about said first-mentioned axis, and trim and tilt means which are arranged to effect pivotal displacement of the drive shaft housing about said second-mentioned axis.

BACKGROUND OF THE INVENTION

Conventional boat propulsion units of the above-mentioned type, for example so-called Aquamatic® drive units, incorporate a carrier screwed to the boat transom. The propeller drive shaft housing is suspended from the carrier by means of a forked bracket which is pivotable about a horizontal transverse axis accommodated in the carrier. A substantially vertical steering axis or spindle is connected to the drive shaft housing and is journalled in the forked bracket. A steering arm cooperates with said spindle. The steering mechanism of the boat, for example a push-pull cable or a servo unit, acts on the steering arm in order to cause its displacement and thereby that of the propeller drive shaft housing. Trimming and tilting of the drive shaft housing is achieved by pivoting the forked bracket upwardly. This is normally carried out with the help of a pair of hydraulic cylinder arrangements, with one hydraulic cylinder acting on each leg of the forked bracket.

SUMMARY OF THE INVENTION

It is a general object of the present invention to provide a boat propulsion unit which can be produced at a considerably lower cost than propulsion units of the above-described known type and which, in addition, is simpler to install on a boat.

This is achieved in accordance with the present invention by means of a combined steering, trim and tilt arm in the form of a powered telescopic arrangement being pivotally attached at its one end to the drive shaft housing so as to impart pivotal displacement of the arm and the drive shaft housing relative to each other about a horizontal axis and which arm at, or in proximity to, an opposite end on the inside of the transom presents means for connection to a steering mechanism, and in that at a point between its ends the arm is connected to the boat via a universal joint in order to achieve a steering displacement of the drive shaft housing by pivoting the arm about an axis accommodated in a vertical plane.

BRIEF DESCRIPTION OF THE DRAWINGS

Advantages attained by the invention will be apparent from the following description and with reference to the embodiment shown in the attached drawings, of which

BEST MODE OF CARRYING OUT THE INVENTION

Figure 1:
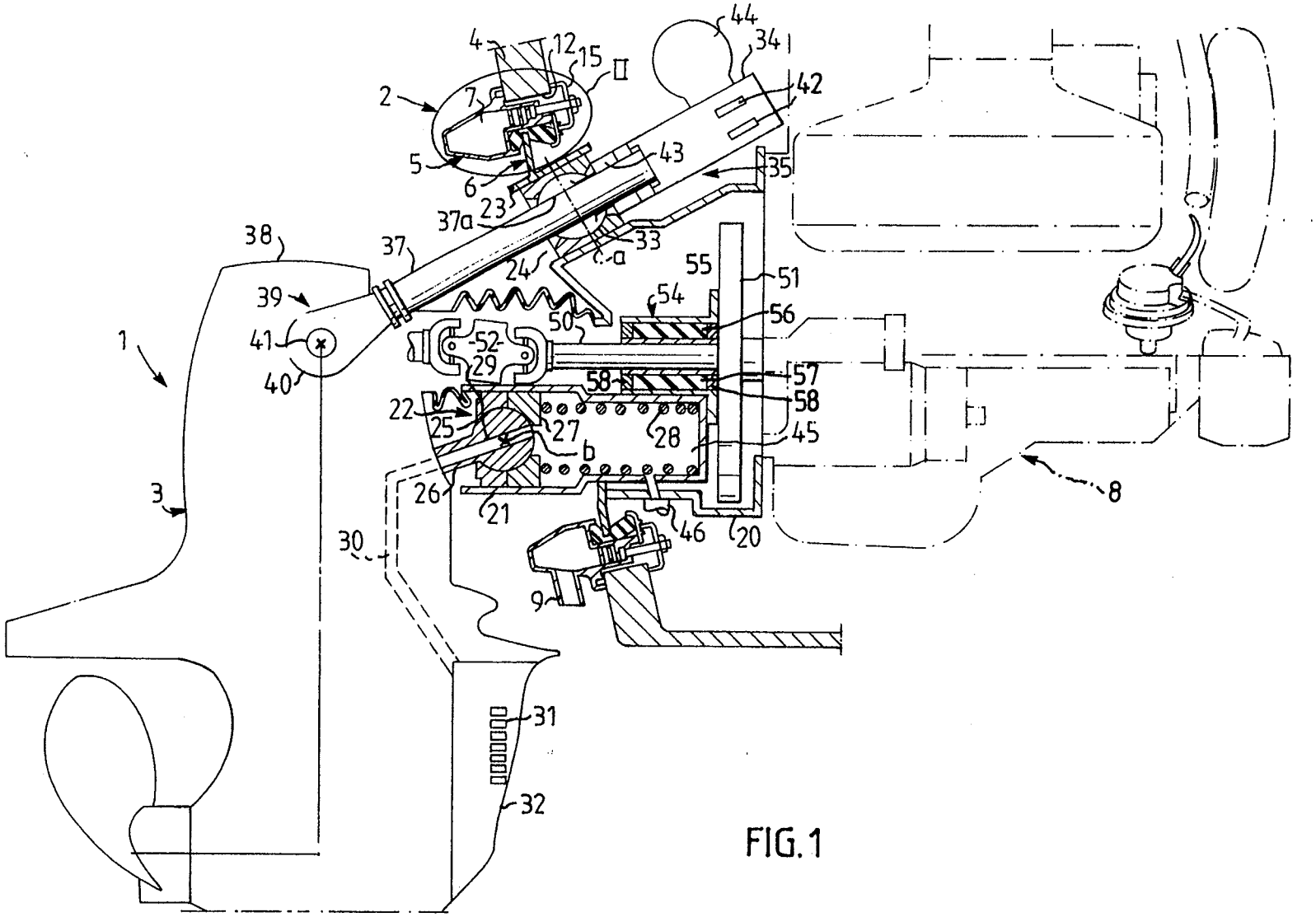
FIG. 1 shows a schematic partial sectional view of a boat propulsion unit according to the invention and FIG. 2 is an enlargement of the region II of FIG. 1.
Figure 2:
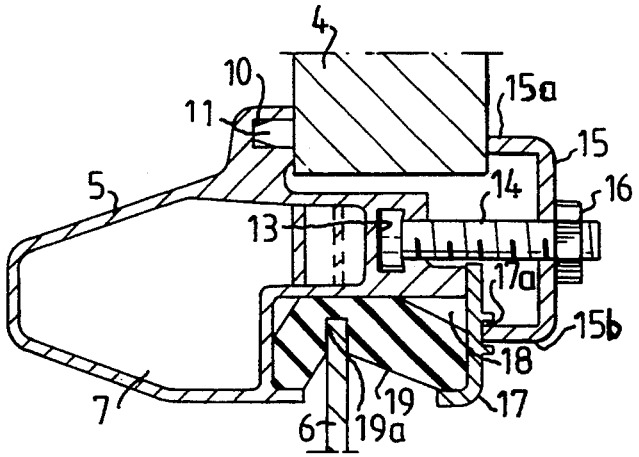

In FIG. 1, reference numeral 1 generally denotes a boat propulsion unit of the so-called INU-type, for example an Aquamatic®-drive unit, which consists of two main components, namely a suspension arrangement 2 and a propeller drive shaft housing 3.

The suspension arrangement 2 consists of two main parts, i.e. a frame member 5 affixed to a boat transom 4 and an inner carrier 6 supported by the frame member 5. The frame member 5 is an extruded aluminum profile, which presents a hollow cavity 7 that can be used for various purposes. For example, the cavity can be used to conduct exhaust gases and cooling water from an engine 8 connected to the propulsion unit 1, whereby the cavity presents an inlet (not shown) and an outlet 9 for the cooling water and the exhaust gases. Alternatively, the frame member 5 can be used as a cooler for various fluids, for example engine oil, whereby the lubrication system of the engine communicates via not shown inlets and outlets with the cavity 7 in the frame member 5.

The aluminum profile which forms the frame member 5 is provided with a U-shaped slot 10 in which a seal 11 is inserted. The frame member 5 is affixed to the outside of the boat transom 4 so that the seal 11 surrounds and seals against the edge of an opening 12 in the transom 4. To achieve this, the profile 5 is provided with a T-shaped slot 13 within which a plurality of uniformally distributed screws 14 having heads adapted to the shape of the slot 13 project. Each screw 14 extends through an opening in a U-shaped yoke 15 and clamps one leg 15*a* of the yoke against the edge of the opening 12 by means of a nut 16. The other leg 15*b* of the yoke projects into a shallow slot 17*a* in a covering ring 17, this ring forming the one delimitation of a U-shaped channel 18 in which a ring 19 of flexible material is accommodated. The ring 19 presents a slot 19*a* into which an edge region of the inner carrier 6 projects, so that a damped suspension of the inner carrier 6 is achieved in the frame member 5.

The described arrangement provides for very simple mounting of the suspension arrangement 2 of the drive shaft housing 3. The profile 5 is presented to the outside of the transom with the yokes 15 loosely carried on the screws 14 and turned through 90° from the position shown in the drawings. After inserting the inner carrier 6 with the damping ring 19 in the channel 18 and applying the covering ring 17, the yokes 15 are rotated to the position showed in the drawings, whereafter the nuts 16 are tightened. The inner carrier 6 is now attached and resiliently supported within the opening 13 in the transom. The drive assembly consisting of the cooperating engine and propulsion unit hereby has a common center of gravity which is located a short distance from the plane of the damping ring 19. This implies that the need for further engine mountings is avoided.

The inner carrier 6 is shaped so that it forms a flywheel casing 20 for the connected engine 8. A cylinder 21 for a lower ball-type universal joint, generally denoted by 22, and a seat 23 for an upper ball-type universal joint, generally denoted by 24, is formed integrally in the shown embodiment with the inner carrier 6, though may also be in the form of separate components fixedly attached to the carrier. This also applies for the flywheel casing 20.

The lower ball-joint 22 has a ball 25 which is rigidly connected to the drive shaft housing 3 via a neck 26 and is accommodated in a spherical recess in a piston member 27. The piston member 27 is displaceable in the cylinder 21 against the action of a helical spring 28 accommodated in the cylinder. The ball 25 and the neck 26 present a through-passage 29 which communicates with a conduit 30 in the drive shaft housing 3. The conduit 30 is in communication with a cooling water inlet 31 in the underwater casing 32 of the drive shaft housing.

The upper ball-joint 24 has a ball 33 which is fixedly attached to a hydraulic cylinder 34 of a hydraulic piston-cylinder arrangement, generally denoted by 35. The piston rod 37 of the piston-cylinder arrangement displaceably extends through a bore 37*a* in the ball 33. The piston rod 37 extends forwardly and rearwardly from the ball joint 24 and towards an upper region 38 of the drive shaft housing 3 and, at its remote end, carries a forked bracket 39 which is clamped to the drive shaft housing region 38. The legs 40 (only one of which is shown) of the forked bracket 39 are pivotally connected via pivot pins 41 to the drive. shaft housing region 38 to thereby permit pivotal displacement about the pivot pins 41. The cylinder 34 presents a pair of attachment rings 42 to which a not-shown steering mechanism, for example a push-pull cable or a servo unit, of a type known per se is intended to be connected in order to convert displacement of the steering wheel into sideways pivotal displacement of the piston-cylinder arrangement 35.

During pivotal displacement of the arrangement 35 about an axis "a" lying in a vertical plane by means of the steering mechanism, the drive shaft housing 3 is swung sideways, corresponding to displacement of a conventional drive shaft housing which has a steering spindle with steering arm journalled to a forked bracket. The hydraulic arrangement 35 thus serves as a tiller. When hydraulic oil is supplied to the cylinder space 43 of the cylinder 34 from a hydraulic pump 44, the drive shaft housing 3 is displaced about a horizontal axis "b" for trimming or tilting of the rig. The hydraulic arrangement consequently also serves as a trim-cylinder and tilt-cylinder. The double trim-cylinders and the steering arm of the known propulsion unit described earlier are hereby replaced by a single piston-cylinder arrangement 35 which, in combination with the embodiment of a forked bracket 39 on an angled cylinder arrangement 35, provides high stability whilst ensuring that the drive shaft housing not only can be trimmed, but also can be tilted upwardly by a necessary amount, for example 45°.

As described above, by means of conducting cooling water through the lower ball 25, the need for a separate cooling water conduit between the drive shaft housing and the engine is eliminated. Ram pressure created by water flowing into the cooling water inlet 31 in the drive shaft housing 3 is dependent on the speed of the boat and will act in the cylinder space 45 of the cylinder 21. This pressure acts together with the spring arrangement 29 in a direction opposite to the propeller pressure force. The spring force can be balanced against the propeller pressure force so that the ram pressure can be used to provide automatic trimming of the drive shaft housing 3 as the speed increases. This is achieved by means of the piston member 27 which carries the ball 25 being displaced rearwardly when the pressure increases in the cylinder space 45. The cylinder 21 presents a throttled outlet 46 to which a cooling-water intake of the engine is intended to be connected. A conduit to a pressure log can also be connected to the outlet 46. The helical spring 28 illustrated in FIG. 1 can, if necessary, be replaced by a gas spring.

The above-described compact embodiment of the drive arrangement consisting of propulsion unit and engine allows a short intermediate shaft 50 to be used between the flywheel 51 of the engine and the drive joints 52 of the drive shaft housing 3. The shaft does not need to be supported by an intermediate bearing, but can be coupled to the flywheel 51 via an elastic joint 54 which includes an outer sleeve 55 which is non-rotatably fastened to the flywheel, an inner sleeve 56 non-rotatably attached to the shaft, an intermediate bush 57 vulcanised to the sleeves 55, 56 and a pair of bearing rings 58 made of low friction plastics, for example nylon.

What is claimed is:

1. Boat propulsion unit intended to be suspended on the outside of a boat transom and driveably connected to an engine on the inside of the transom, said unit comprising a propeller drive shaft housing, a suspension arrangement intended to be fixedly secured to the transom, upper and lower universal joints which pivotally connect the drive shaft housing to the suspension arrangement to allow pivotal displacement of the drive shaft housing relative to the suspension arrangement about a pivot axis in a vertical plane and pivot axis in a horizontal plane, steering means which are arranged to effect pivotal displacement of the drive shaft housing about said first-mentioned axis, and trim and tilt means which are arranged to effect pivotal displacement of the drive shaft housing about said second-mentioned axis, a combined steering, trim and tilt arm (35) in the form of a powered telescopic arrangement being pivotally attached at its one end (29) to the drive shaft housing (3) so as to impart pivotal displacement of the arm and the drive shaft housing relative to each other about a horizontal axis (41) and which arm at, or in proximity to, an opposite end on the inside of the transom (4) presents means (42) for connection to a steering mechanism, and at a point between its ends the arm is connected to the boat via said upper universal joint (24) in order to achieve a steering displacement of the drive shaft housing (3) by pivoting the arm about an axis (a) accommodated in a vertical plane.

2. Boat propulsion unit according to claim 1, wherein the powered telescopic arrangement is a hydraulic piston-cylinder arrangement (35), the piston rod (37) of which is pivotally connected at its remote end to the drive shaft housing (3) and the cylinder (34) of which is carried by the upper universal joint (24).

3. Boat propulsion unit according to claim 2, wherein the universal joint (24) is a ball-joint.

4. Boat propulsion unit according to claim 1, wherein the suspension arrangement (2) comprises both a frame member (5) which is intended to be fixed around an opening (12) in the boat transom (4) and a carrier (6) which is attached to the frame member, the carrier covering the opening and supporting the upper universal joint (24).

5. Boat propulsion unit according to claim 1, wherein at its remote end the telescopic arm (35) presents a forked bracket (39) connected to an upper region (38) of the drive shaft housing and is pivotally journalled to the drive shaft housing for pivotal displacement relative thereto about a horizontal axis.

* * * * *